US007154517B2

(12) United States Patent
Kawasaki et al.

(10) Patent No.: US 7,154,517 B2
(45) Date of Patent: Dec. 26, 2006

(54) IMAGE FORMING APPARATUS

(75) Inventors: Shinpei Kawasaki, Hachioji (JP); Tadashi Matsudaira, Hachioji (JP); Hiroshi Oyama, Hino (JP); Katsunori Takahashi, Hachioji (JP); Masayuki Watanabe, Fuchu (JP)

(73) Assignee: Konica Minolta Business Technologies, Inc. (JP)

( * ) Notice: Subject to any disclaimer, the term of this patent is extended or adjusted under 35 U.S.C. 154(b) by 222 days.

(21) Appl. No.: 10/891,555

(22) Filed: Jul. 15, 2004

(65) Prior Publication Data

US 2005/0110859 A1 May 26, 2005

(30) Foreign Application Priority Data

Nov. 20, 2003 (JP) ..... 2003-390038

(51) Int. Cl.
*B41J 2/45* (2006.01)

(52) U.S. Cl. ..... 347/133; 347/236

(58) Field of Classification Search ..... 347/129, 347/130, 131, 132, 133, 236, 246
See application file for complete search history.

(56) References Cited

U.S. PATENT DOCUMENTS 5,808,651 A * 9/1998 Horiuchi ..... 347/131
6,147,698 A * 11/2000 Zable et al. ..... 347/240
6,831,672 B1 * 12/2004 Maeda ..... 347/234

FOREIGN PATENT DOCUMENTS

| | | | |
|---|---|---|---|
| JP | 08-230234 | * | 9/1996 |
| JP | 2000-071508 | | 3/2000 |
| JP | 2001-310498 | * | 11/2001 |
| JP | 2003-127459 | * | 5/2003 |

OTHER PUBLICATIONS

* English Abstract for JP 2000-071508.

* cited by examiner

*Primary Examiner*—Huan Tran
(74) *Attorney, Agent, or Firm*—Cantor Colburn LLP

(57) ABSTRACT

This invention provides an image forming apparatus that can suppress variations in writing densities of LED heads and form stable images.

An image forming apparatus has an image retainer 1 for retaining a toner image, an image writing unit 3 equipped with a plurality of LED heads 31 to form a static latent image the image retainer 1, a developing unit 4 for developing the static latent image formed by the image writing unit 3 with a developing agent, a patch formation controller 23 for forming patches for each LED head on the image retainer 1, a density detector 25 for detecting the density of each patch formed by the patch formation controller 23, and a correction controller 26 for correcting the light amount of each LED head by the density detected by the density detector 25.

14 Claims, 5 Drawing Sheets

| DENSITY VALUE | CORRECTION VALUE |
|---|---|
| D1 | P1 |
| D2 | P2 |
| D3 | P3 |
| ⋮ | ⋮ |
| Dn | Pn |

IMAGE FORMING APPARATUS

BACKGROUND OF THE INVENTION

1. Field of the Invention

This invention relates to an image forming apparatus having a plurality of LED heads and capable of forming stable images by equalizing light intensities of LED heads.

2. Description of the Related Art

A conventional image forming apparatus uses, as an image writing means, an LED head that has a line of LED elements along the main scanning direction. To make image recording faster and the service lives of LED elements longer, such an apparatus uses two or more LED heads and switches these heads by lines or by pages. If the light intensities of the LED elements are not equal, resulting images may have irregular densities.

Japanese Non-examined Patent Publication 2000-71508 discloses an image forming apparatus with a plurality of LED heads that are switched each time one image line is formed. This invention has an effect to eliminate unwanted white or black lines caused by different dot diameters of LED elements.

Although this prior art can eliminate unwanted white or black lines, the resulting images cannot be free from having density irregularities due to uneven light intensities of LED heads.

In other words, the prior art cannot suppress density irregularities in images recorded by the LED heads.

SUMMARY OF THE INVENTION

This invention is related to an image forming apparatus has an image retainer, at least two LED heads for forming an electrostatic latent image on the retainer each of which has a plurality of LED elements, a developing unit for developing the electrostatic latent image, a patch forming unit for forming patches on the image retainer by using the LED heads and the developing unit, a detector for detecting the densities of the patches, and a correcting unit for correcting the light amount of at least one of the LED heads according to the patch densities detected by the detector.

This invention is also related to an image forming apparatus has at least two LED heads for forming an electrostatic latent image each of which has a plurality of LED elements, a detector for detecting the light amount of each LED head, and a correcting unit for correcting the light amount of the LED heads according to the light amount of each LED head detected by the detector.

DETAILED DESCRIPTION OF THE PREFERRED EMBODIMENTS

This invention will be described in further detail by way of embodiments.

The first embodiment of the invention will be explained below.

Figure 1:
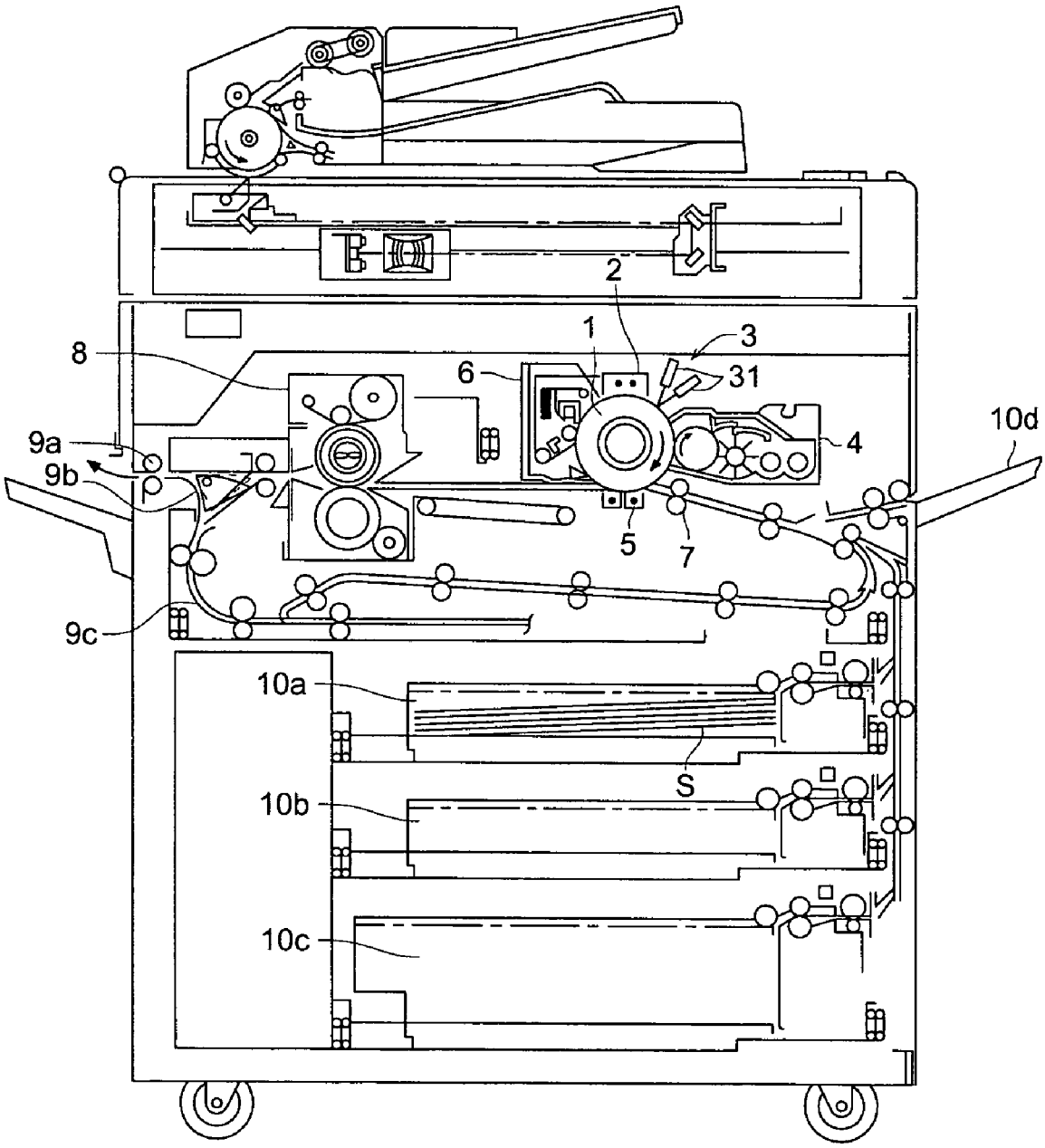
FIG. 1 is a vertical sectional view of an image forming apparatus that is an embodiment of this invention.

FIG. 1 is a vertical sectional view of an image forming apparatus that is an embodiment of this invention. The image forming apparatus has a charging unit 2, an image writing unit 3, a developing unit 4, a transferring unit 5, and a cleaning unit 6 around a drum-shaped image retainer 1. In the image forming apparatus, the charging unit 2 gives an even static electricity to the surface of the image retainer 1 and the image writing unit 3 forms an electrostatic latent image of image data read from a manuscript by scanning and exposing. The developing unit 4 reverses the image and forms a toner image on the surface of the image retainer 1. In this case, the image retainer 1 can be any as long as it can retain a toner image. For example, it can be a belt-like image retainer.

At the same time, a sheet S is supplied to an image transfer position from any of paper feed cassettes 10*a* and 10*b* provided in the middle stage of the image forming apparatus, a large-capacity paper feed cassette 10*c* provided in the lower stage of the image forming apparatus and a manual paper feed tray 10*d* via a resist roller 7. In the image transfer position, the toner image is transferred onto the sheet S by the transferring unit 5 and thermally fixed to the sheet by the fixing unit 8. The sheet S is ejected by the ejection roller 9*a*.

When forming an image on each side of the sheet S, the sheet S that is thermally fixed by the fixing unit 8 is branched from the normal sheet ejection route by the route switching plate 9*b*, turned over by the turn-over delivery section 9*c*, passed over the transferring unit 5 to have an image on the other side of the sheet, fixed by the fixing unit 8, and ejected to the outside of the image forming apparatus by the ejection roller 9*a*. Then the cleaning unit 6 removes the left-over developing agent from the surface of the image retainer 1 to be ready for the next image formation.

In FIG. 1, the image writing unit 3 has two LED heads 31 and 32. However, this invention is applicable to an image forming apparatus as long as the apparatus has a plurality of LED heads 31 for one image retainer 1 and it is to be understood that the invention is not intended to be limited to two LED heads. The LED heads 31 are switched at certain timing such as by line or by page for use. Each of the LED heads 31 is calibrated in advance to equalize the light intensities of the LED elements in the LED heads 31.

Figure 2:
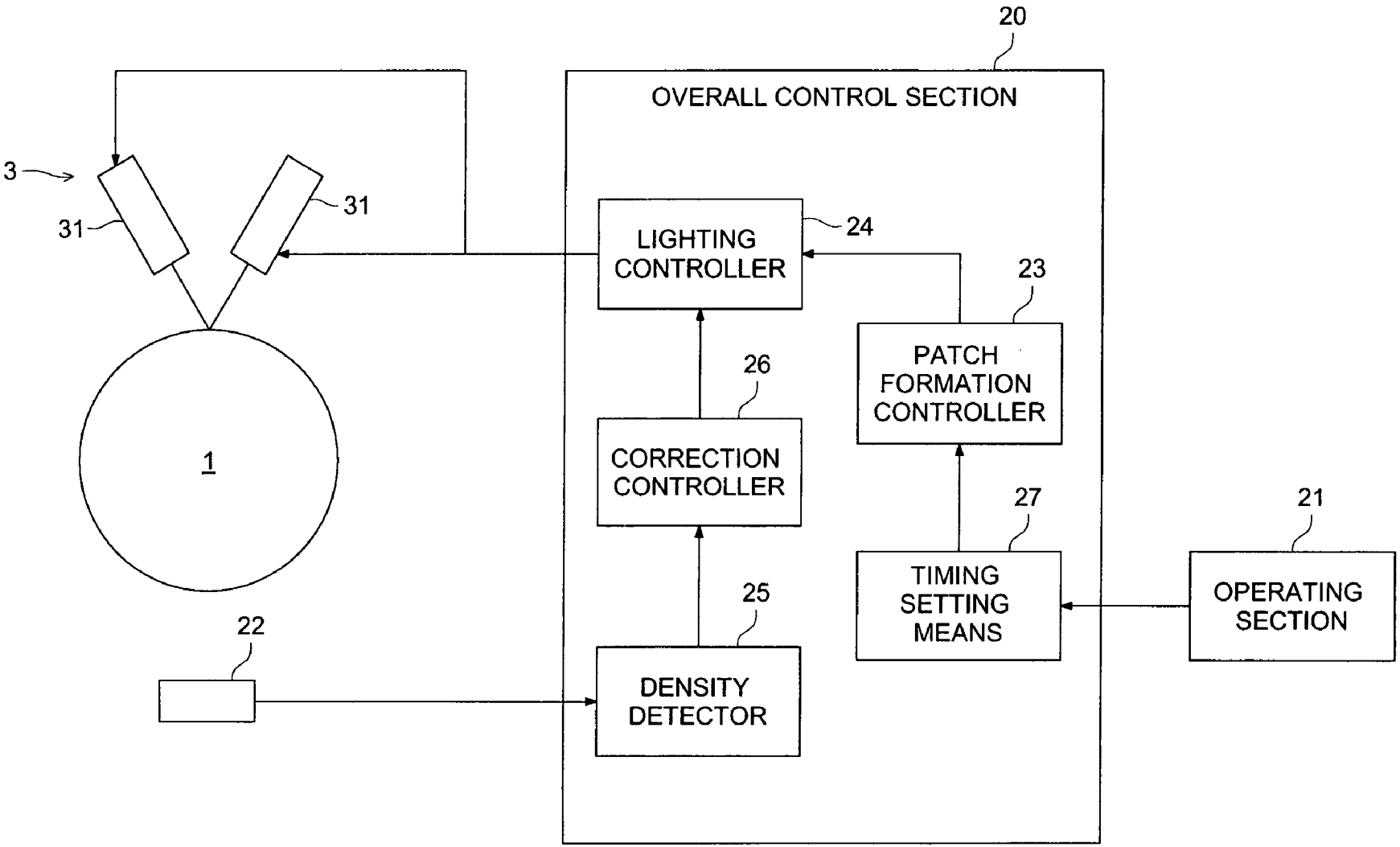
FIG. 2 is a functional block diagram of an image forming apparatus that is an embodiment of this invention.

FIG. 2 is a functional block diagram of an image forming apparatus that is an embodiment of this invention. The overall control section 20 controls driving of the image retainer 1, the image writing unit 3, and so on respectively. The operating section 21 has a hard-key section equipped with buttons for setting the number of image copies and starting image formation and a touch-sensitive panel section for displaying a setting and setting an image formation mode.

The image retainer 1 has sensors 22 for detecting densities of a toner image formed by the image writing unit 3 and the developing unit 4. These sensors 22 are provided between the developing unit 4 and the transferring unit 5 with their sensing ends faced towards the surface of the image retainer 1.

Figures 3, 4:
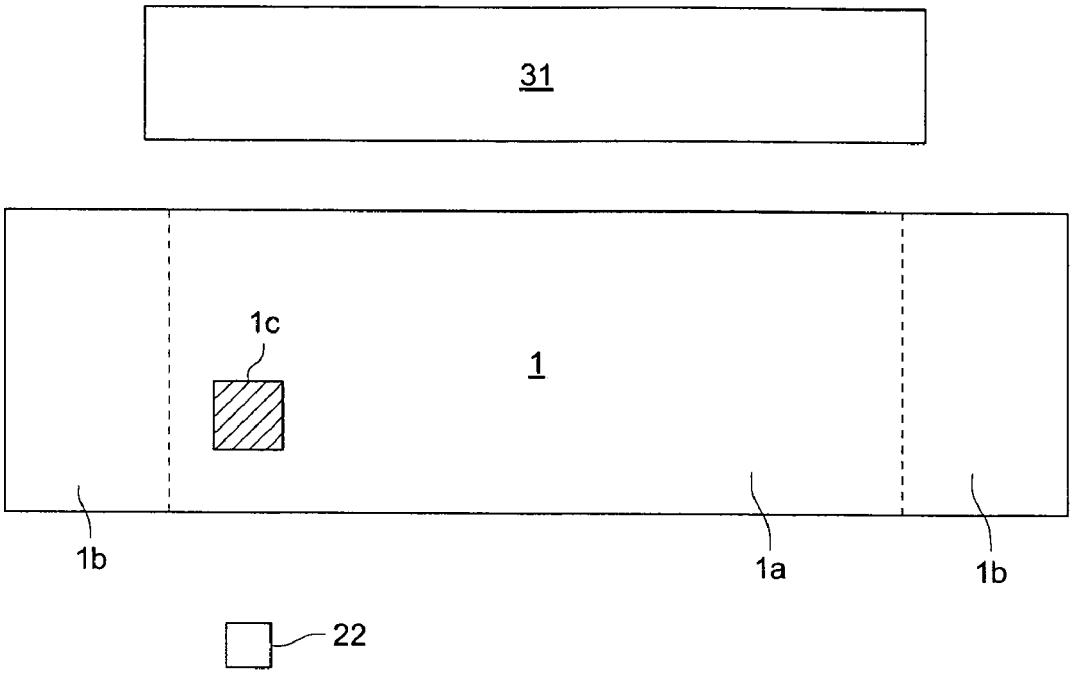
FIG. 3 is a side view of the image retainer and the LED head.
FIG. 4 is a table showing a relationship between actual density values and corrected values used by the correcting controller.

FIG. 3 is a side view of the image retainer 1 and the LED head 31. As shown in FIG. 3, the LED head 31 is disposed with its longitudinal axis along the main scanning direction. In other words, the LED head 31 is placed across the movement of the image retainer 1. The image retainer 1 has an image forming area 1*a* in the center and marginal areas 1*b* on both side of the image forming area 1*a*. The LED head 31 is longer than the length of the image forming area 1*a*. The sensor 22 is provided to detect the density of a toner image formed on the image forming area 1*a*. A sensor 21 can be a pair of a light emitting element and a light receiving element.

The patch formation controller 23 forms a fill-in image called a "patch" on a place on the surface of the image retainer 1 where the sensor 22 can detect it. For example, as shown in FIG. 3, the patch can be rectangular (e.g. patch 1*c*) and greater than the sensor 22. It can also be provided on the whole periphery of the image retainer 1.

Referring to FIG. 2, the lighting controller 24 controls to turn on and off the LED elements of the LED head 31 according to patch data sent from the patch formation controller 23 or image data obtained by scanning a manuscript. To assure detection of patches, it is preferable to give image signals of the highest density to the LED elements and form patches with a black toner.

The developing unit 4 turns the patch 1*c* that was formed as an electrostatic latent image on the image retainer 1 by the patch formation controller 23 and the lighting controller 24 into a patch toner image.

The density detector 25 converts density signals coming from the sensor 22 into numeric values. The numeric values representing the patch densities are dependent upon performances of sensors 22. Some sensors represent densities by numeric values of 0 (lightest) to 255 (darkest). The correction controller 26 correct the light intensity of the LED head 31 by a numeric value representing the density of a patch 1*c* sent from the density detector 25.

FIG. 4 is a table showing a relationship between actual density values and corrected values used by the correcting controller. This table is stored in a memory (which is not shown in FIG. 4) in the image forming apparatus. The "Density value" in the table represents a numeric value obtained by the density detector 25. For example, when "n" is 256, density values D1 to D256 are 0, 1, 2, . . . , 254, and 255 in that order. As the numeric value goes greater, the density becomes higher. The "Correction value" in the table represents a current value for respective density values that is required to correct the light intensities of the LED heads 31 to make them even. As the image forming apparatus of this invention employs a type that forms a toner image on the surface of the image retainer that is exposed to the light from the LED head. Therefore, it can be said that the density value represents the intensity of light from the LED head.

It is also possible to store values at a preset interval (e.g. 5 for D1, 10 for D2, and so on) instead of numeric values of 0 to 255 and use a correction value P1 corresponding to the density value D1 when the value from the density detector 25 is 5 or less. Further, the current values of the LED head 31 can be substituted with "on" periods of the LED head 31.

The correction of light intensities of the LED heads 31 is implemented while the image formation is not in progress. To put it concretely, the light intensity correction is implemented immediately after the subsidiary power supply of the image forming apparatus is turned on or after a series of image forming processes called as a job and before the next job starts. Further, it can be done periodically, for example once a week or once a month instead of implementing each time when the subsidiary power supply of the image forming apparatus is turned on or between two consecutive jobs. When the operating section enables the user to set the timing to implement the light intensity correction, it is very convenient as the light intensity correction can be implemented at an optimum timing according to the service frequency of the image forming apparatus.

The timing setting means 27 of FIG. 2 receives user-set information of timing to implement the light intensity correction from the operating section and passes the information to the patch formation controller 23. When receiving the timing information from the timing setting means 27, the patch formation controller 23 check the correction timing and implements the light intensity correction when it is the specified correction timing. For example, when the user sets to implement a light intensity correction between jobs, the patch formation controller checks whether a job is currently running and implements the light intensity correction when no job is running and if a light intensity correction has not been implemented since the end of the previous job.

Figure 5:
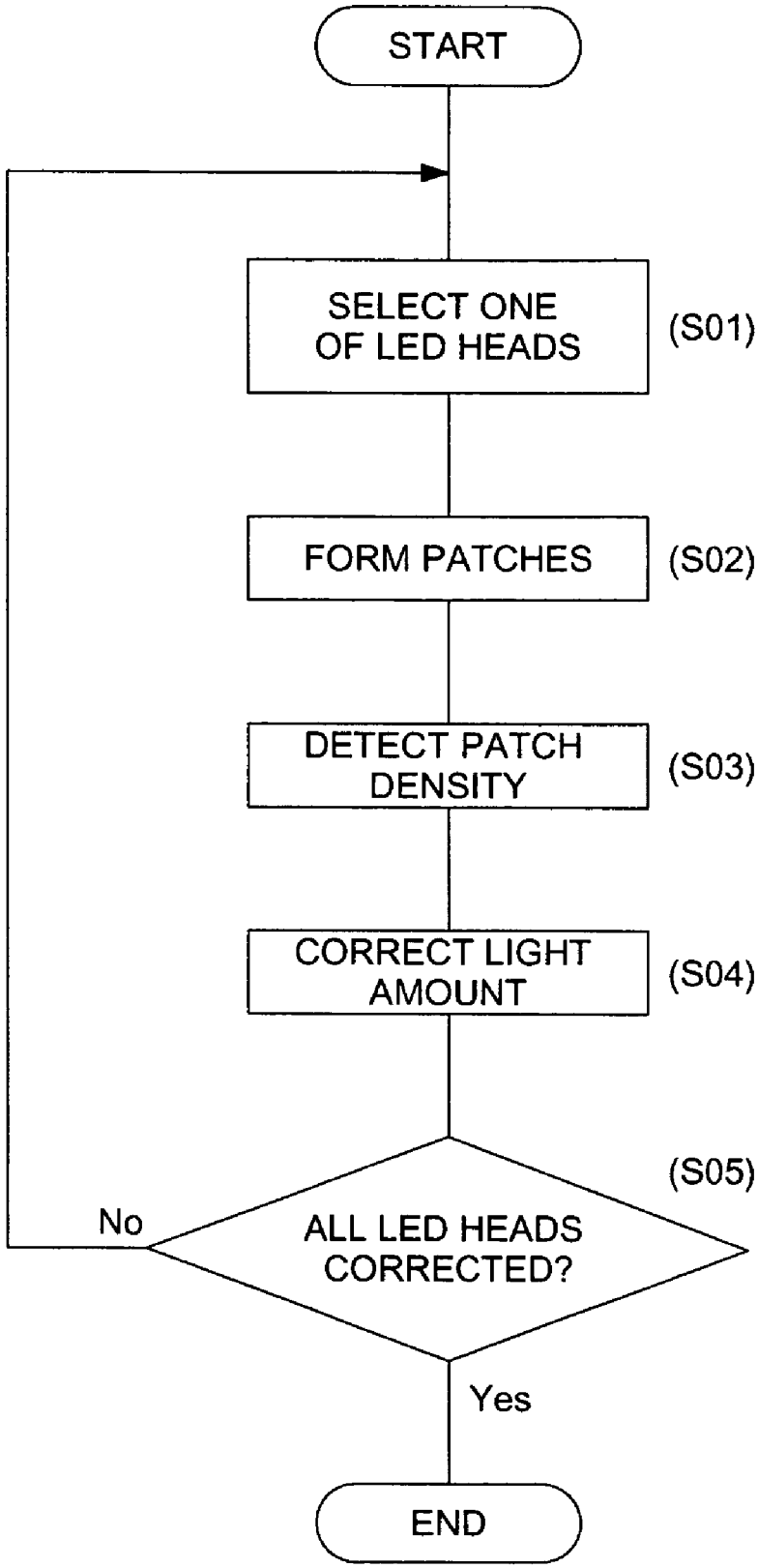
FIG. 5 shows a flow chart of correcting light intensities of LED heads.

FIG. 5 shows a flow chart of correcting light intensities of LED heads. This flow chart is implemented when the patch formation controller 23 judges that it is the timing to implement the light intensity correction from the information sent from the timing setting means. When the flow chart is implemented, the patch formation controller selects one of the LED heads 31 whose light intensities have not been completed. (S01) Then the lighting controller 24 forms a patch 1*c* sent from the patch formation controller 23 on the image retainer 1 by using the LED head 31 selected at S01. (S02) The density detector 25 detects the density of the patch 1*c* by the sensor 22. (S03) The correction controller 26 looks for a density value detected at S03 in the table of FIG. 4 and gets a corresponding correction value. The correction controller sends the correction value to the lighting controller. (S04) The patch formation controller 23 checks whether all LED heads 31 are corrected. (S05) When finding a LED head 31 that has not been corrected, control is returned to step S01 and the above steps are repeated. When a normal image formation is made after all LED heads complete their light intensity corrections, the lighting controller 24 controls a current (or an "on" period) for the relevant LED head according to the correction value for the LED head selected at S04.

There can be another correction method. This method gets a difference between a patch density from one of the LED heads 31 and a patch density from the other and correct the light intensity of either of the LED heads 31 according to this difference (increasing the light intensity if the light intensity of the LED head is smaller or decreasing the light intensity if the light intensity of the LED head is greater). In other words, this method eliminates the relative intensity difference between the LED heads and this equalizes the light intensities of the LED heads. When three or more LED heads are used, the light intensities of LED heads are corrected according to the differences between the light intensity of each LED head and the greatest light intensity of the LED heads Next will be explained the second embodiment of this invention.

Figure 6:
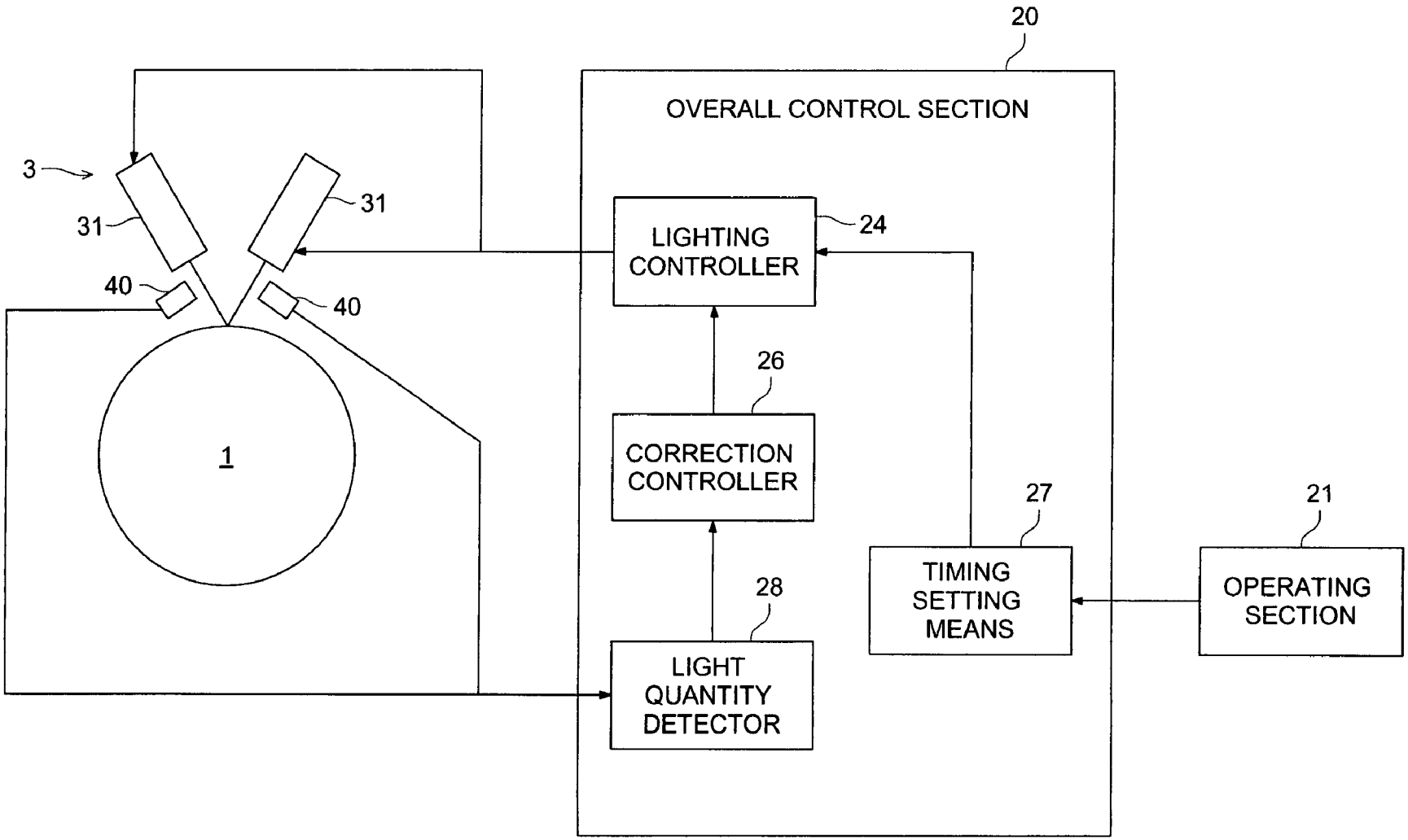
FIG. 6 is a functional block diagram of an image forming apparatus that is another embodiment of this invention.

The second embodiment is the same as the first embodiment in the basic configuration. This embodiment will be explained referring to FIG. 6 wherein like reference characters designate corresponding parts in the several views.

In the second embodiment, each LED head 31 has a light intensity sensor 40 to measure the light intensity of the LED head. This sensor 40 detects the light intensity of the LED head 31 at the timing set by the operating section 21. The timing of detection (measurement) is not limited to the timing set by the operating section 21, for example, it can be periodic. The value measured by the sensor 40 is sent to the light amount detector 28. The correction controller 26 calculates a correction value for the measured value. The lighting controller 24 receives this calculated correction value and control the light intensity of the relevant LED 30.

This invention is also applicable to a color image forming apparatus that has a plurality of LED heads for each color.

This invention can provide an image forming apparatus that can suppress variations in writing densities of LED heads and form stable images.

Further, this image forming apparatus consists of an image retainer, an image writing unit having a plurality of LED heads, a developing unit, a patch formation controller, a density detector, and a correction controller. The patch formation controller selects one of LED heads in the image writing unit which has not undergone a light intensity correction and forms, on the image retainer, an electrostatic latent image for a toner image used to measure the light intensity. The developing unit develops the latent image into a toner image with a developing agent. The density detector detects the density of the toner image on the image retainer and correct the light intensity of the relevant LED head according to the density detected by the correction controller. These steps are repeated for every LED head in the image writing unit. With this, all LEDs in the image writing unit have the identical light intensity and the resulting image has no density irregularity.

The above light intensity correction is implemented on LED heads when the image forming apparatus is powered on. This can equalize light intensities of the LED heads before the image forming apparatus is used and suppress formation of abnormal images.

Further, as the light intensity correction is implemented after each image formation job, the image forming apparatus can form images of a stable quality.

Furthermore, the image forming apparatus has an operating section that enables the user to operate the image forming apparatus. The user can set a time point to implement the light intensity correction on respective LED heads. The set timing information is passed from the timing setting means to the patch formation controller. The patch formation controller judges the timing to implement the light intensity correction by the information. This enables the user to implement the light intensity correction at desired time points.

What is claimed is:

1. An image forming apparatus comprising:

an image retainer;

at least two LED heads for forming an electric latent image on the retainer, each of the LED heads having a plurality of LED elements;

a developing unit far developing the electric latent image;

a patch forming unit for forming patches on the image retainer by using each of the LED heads and the developing unit;

a detector for detecting density of the patches; and a correcting unit for correcting light amount of at least one of the LED heads according to the density of the patches detected by the detector.

2. The image forming apparatus of claim 1, wherein the correcting unit performs the light amount correction on the LED heads when the image forming apparatus is powered on.

3. The image forming apparatus of claim 1, wherein the correcting unit performs the light amount correction on the LED heads after the image forming apparatus completes its jobs.

4. The image forming apparatus of claim 1, wherein the image forming apparatus comprises an operating section and a timing setting means that allows to set time points that the correcting unit performs light amount corrections on LED heads.

5. The image forming apparatus of claim 1, wherein the image forming apparatus comprises a 4-color developing unit.

6. The image forming apparatus of claim 1, wherein two or more LED heads are provided for the developing unit of each color.

7. The image forming apparatus of claim 1, wherein the correcting unit corrects the magnitude of current fed to each LED head by the density of the patches.

8. The image forming apparatus of claim 1, wherein the light amount correction of the first or second LED head is made by a difference between the density of a patch formed by the first LED head and the density of a patch formed by the second LED head.

9. A light amount correcting method for an image forming apparatus, the image forming apparatus having at least two LED heads for forming an electric latent image on an image retainer, each of the LED heads including a plurality of LED elements, comprising:

forming patches on an image retainer corresponding to the each LED heads by using the LED heads and the developing unit;

detecting density of the patches; and correcting light of the LED heads according to the density of the patches detected by the detector.

10. The light amount correcting method of claim 9, wherein the light amount correction on the LED heads is made when the image farming apparatus is powered on.

11. The light amount correcting method of claim 9, wherein the light amount correction on the LED heads is made alter the image forming apparatus completes its jobs.

12. The light amount correcting method of claim 9, wherein time points can be set to perform the light amount correction on the LED heads.

13. The light amount correcting method of claim 9, wherein the image forming apparatus is equipped with developing unit of four colors and LED heads are provided for each color.

14. The light amount correcting method of claim 9, wherein the developing unit of each color is equipped with two or more LED heads.

* * * * *